US010585380B2

(12) United States Patent
Kimpara

(10) Patent No.: US 10,585,380 B2
(45) Date of Patent: Mar. 10, 2020

(54) IMAGE FORMING APPARATUS THAT FORMS AN IMAGE ON A SHEET UNDER AN OPERATION CONDITION SET DEPENDING ON A SHEET TYPE

(71) Applicant: Konica Minolta Inc., Tokyo (JP)

(72) Inventor: Noriyuki Kimpara, Toyohashi (JP)

(73) Assignee: Konica Minolta Inc., Tokyo (JP)

( * ) Notice: Subject to any disclaimer, the term of this patent is extended or adjusted under 35 U.S.C. 154(b) by 0 days.

(21) Appl. No.: 16/290,550

(22) Filed: Mar. 1, 2019

(65) Prior Publication Data

US 2019/0302667 A1 Oct. 3, 2019

(30) Foreign Application Priority Data

Apr. 3, 2018 (JP) ..... 2018-071301

(51) Int. Cl.
*G03G 15/00* (2006.01)

(52) U.S. Cl.
CPC ..... *G03G 15/5029* (2013.01); *G03G 15/5025* (2013.01); *G03G 15/5037* (2013.01); *G03G 2215/00751* (2013.01); *G03G 2215/00966* (2013.01); *G03G 2215/1685* (2013.01)

(58) Field of Classification Search
CPC ..... G03G 15/5029; G03G 15/5037; G03G 15/5025; G03G 2215/00966; G03G 2215/1685; G03G 2215/00751
See application file for complete search history.

(56) References Cited

U.S. PATENT DOCUMENTS

2005/0111015 A1* 5/2005 Tsujimoto ..... G06K 15/005 358/1.9
2011/0200342 A1* 8/2011 Furuyama ..... G03G 15/2064 399/18

FOREIGN PATENT DOCUMENTS

JP 2009151104 A 7/2009
JP 2013007961 A 1/2013
JP 2015014695 A 1/2015

* cited by examiner

*Primary Examiner* — G. M. A Hyder
(74) *Attorney, Agent, or Firm* — Rankin, Hill & Clark LLP

(57) ABSTRACT

An image forming apparatus that forms an image on a sheet under an operation condition set depending on a sheet type, includes a hardware processor that: detects whether the sheet type is any one of a plurality of assumed types; performs control such that an activation operation for forming the image under an interim condition, which is an operation condition corresponding to one of the plurality of assumed types, is performed before detecting the sheet type; determines whether or not a recovery operation for optimizing a state of image formation is performed before starting image formation under a determinate condition, which is an operation condition corresponding to the detected type; performs control such that the recovery operation is performed when it is determined that the recovery operation is performed; and performs control such that the image formation is performed under the determinate condition after the recovery operation is performed.

8 Claims, 13 Drawing Sheets

FIG. 4

D25

| | Ds | Dd | Dk |
|---|---|---|---|
| TRAY | SIZE | ORIENTATION | TYPE |
| SHEET FEED TRAY 25a | A4 | HORIZONTAL (H) | (UNKNOWN) |
| SHEET FEED TRAY 25b | A4 | HORIZONTAL (H) | PLAIN SHEET A |
| SHEET FEED TRAY 25c | A4 | VERTICAL (V) | THICK SHEET 5A |
| MANUAL TRAY 25d | A3 | VERTICAL (V) | THICK SHEET 1B |

FIG. 5

D10

| TYPE | | | OPERATION CONDITION VALUE | | | |
|---|---|---|---|---|---|---|
| TYPE NAME | SMOOTHNESS OF SURFACE | BASIS WEIGHT [g/m²] | PROCESS SPEED Vsys [mm/s] | FOGGING MARGIN Vm [V] | FIXATION TEMPERATURE Ts [°C] | SECONDARY TRANSFER OUTPUT V16 [V] |
| THIN SHEET A | (UNCOATED) | 51 TO 60 | 290 | 150 | 145 | 1300 |
| THIN SHEET B | (COATED) | | | 170 | | 1200 |
| PLAIN SHEET A | (UNCOATED) | 61 TO 90 | | 150 | 165 | 1600 |
| PLAIN SHEET B | (COATED) | | | 170 | | 1500 |
| THICK SHEET 1A | (UNCOATED) | 91 TO 120 | 210 | 130 | 140 | 1300 |
| THICK SHEET 1B | (COATED) | | | 150 | | 1200 |
| THICK SHEET 2A | (UNCOATED) | 121 TO 160 | | 130 | 150 | 1600 |
| THICK SHEET 2B | (COATED) | | | 150 | | 1500 |
| THICK SHEET 3A | (UNCOATED) | 161 TO 210 | | 130 | 155 | 1900 |
| THICK SHEET 3B | (COATED) | | | 150 | | |
| THICK SHEET 4A | (UNCOATED) | 211 TO 260 | 105 | 120 | 140 | 1600 |
| THICK SHEET 4B | (COATED) | | | 130 | | 1500 |
| THICK SHEET 5A | (UNCOATED) | 261 TO 300 | | 120 | 150 | 1900 |
| THICK SHEET 5B | (COATED) | | | 130 | | |
| Dk | | | Dc | | | |

INTERIM TYPE Dkp → THICK SHEET 5A

FIG. 6

D40

| | DETECTED TYPE | | | | | | | | |
|---|---|---|---|---|---|---|---|---|---|
| CHANGE AMOUNT FROM PRIOR ACTIVATION CONDITION | GROUP A | GROUP Ba | GROUP Bb | GROUP Bc | GROUP Bd | GROUP Be | GROUP Bf | GROUP Bg | GROUP Bh |
| CHANGE AMOUNT OF PROCESS SPEED Vs | NO CHANGE | NO CHANGE | | CHANGE AMOUNT: SMALL | | | CHANGE AMOUNT: LARGE | | |
| CHANGE AMOUNT OF ELECTRIFICATION DC OUTPUT V5dc (FOGGING MARGIN Vm) | NO CHANGE | CHANGE AMOUNT: SMALL | CHANGE AMOUNT: LARGE | NO CHANGE | CHANGE AMOUNT: SMALL | CHANGE AMOUNT: LARGE | NO CHANGE | CHANGE AMOUNT: SMALL | CHANGE AMOUNT: LARGE |
| NECESSITY OF RECOVERY PROCESSING (RECOVERY PROCESSING) | UNNECESSARY | | NECESSARY (IDLING) | UNNECESSARY | | NECESSARY (DEACTIVATION) | NECESSARY (IDLING) | | NECESSARY (DEACTIVATION) |
| OPERATION AFTER TYPE DETECTION | IMAGE FORMATION | CONDITION SWITCHING ↓ IMAGE FORMATION | CONDITION SWITCHING ↓ IDLING ↓ IMAGE FORMATION | CONDITION SWITCHING ↓ IMAGE FORMATION | | DEACTIVATION ↓ CONDITION SWITCHING ↓ RE-ACTIVATION ↓ IMAGE FORMATION | CONDITION SWITCHING ↓ IDLING ↓ IMAGE FORMATION | | DEACTIVATION ↓ CONDITION SWITCHING ↓ RE-ACTIVATION ↓ IMAGE FORMATION |

IMAGE FORMING APPARATUS THAT FORMS AN IMAGE ON A SHEET UNDER AN OPERATION CONDITION SET DEPENDING ON A SHEET TYPE

The entire disclosure of Japanese patent Application No. 2018-071301, filed on Apr. 3, 2018, is incorporated herein by reference in its entirety.

BACKGROUND

Technological Field

The present invention relates to an image forming apparatus.

Description of the Related Art

An image forming apparatus such as a printer, a copier, or a multi-function peripheral (MFP) has a sheet tray (or cassette) in which a plurality of sheets used as image recording media are set. Printing is performed by conveying a sheet to a print position inside an apparatus from the sheet tray.

As a function of such a type of image forming apparatus, a function of setting an operation condition to obtain a suitable image depending on a sheet type is known in the art. For example, in a photoelectrographic image forming apparatus, a sheet is classified depending on a basis weight, and a conveyance speed (process speed), a transfer bias, a fixation temperature, and the like are set depending on the basis weight. Using this setting, it is possible to prevent a jamming, a transfer failure, a fixation failure, or the like.

As a method of obtaining a sheet type in the image forming apparatus, a manual input is known, in which a user selects the sheet type from several options (such as plain sheet, thick sheet 1, and thick sheet 2) and designates it. The image forming apparatus sets a print operation condition depending on the type manually input by the user.

However, it is cumbersome for a user if the type is designated whenever the sheet type to be set is changed. In addition, a user may forget designation or may erroneously perform designation. For this reason, automatic detection in which the image forming apparatus detects the sheet type on the basis of a predetermined sensor output attracts attention.

As a prior art relating to the image forming apparatus that automatically detects the sheet type, JP 2015-14695 A and JP 2013-7961 A are known in the art.

The image forming apparatus discussed in JP 2015-14695 A determines the sheet type using a sheet type determination sensor provided in a sheet conveyance path. A print preparation operation is performed for printing under a condition suitable for an interim sheet type in parallel with the sheet type determination operation including sheet conveyance. In addition, if the determined sheet type matches the interim sheet type, printing is directly prepared. If the determined sheet type does not match the interim sheet type, printing is prepared by switching to a condition suitable for the determined sheet type. In the technique disclosed in JP 2015-14695 A, in consideration of a delay in print preparation caused by the condition switching, the print preparation is completed without switching the condition as long as possible by determining the interim sheet type on the basis of a history of the sheet type used by a user.

JP 2013-7961 A discloses a photoelectrographic image forming apparatus, in which the start of the printing is expedited by starting a temperature adjustment control of a fixer by roughly determining the type on the basis of the information obtained in advance, before determining a type of a recording material on the basis of information sequentially obtained from two types of sensors.

Note that JP 2009-151104 A discloses a photoelectrographic image forming apparatus that performs a deactivation processing for a latent image forming unit if there is no next print request until a discharge of a recording sheet subjected to printing is detected.

In an image forming apparatus that detects the type by conveying the sheet, image formation preparation starts under a condition suitable for the interim type before detecting the sheet type, so that it is possible to shorten a first print output time (FPOT), compared to a case where preparation starts after the type detection.

However, even when the interim type is determined by applying the technique of JP 2015-14695 A, it is difficult to say that a user uses the sheet of the interim type at all times. Therefore, a situation that the detected type does not match the interim type may occur. That is, it is difficult to eliminate a case where an image is formed by switching from a condition A corresponding to the interim type to a condition B corresponding to the detected type.

In the image forming apparatus of the related art, when an image is formed by switching from the condition A to the condition B in the course of the preparation operation, the image quality may degraded disadvantageously, compared to a case where an image is formed without switching the condition by performing the preparation operation so as to form the image by setting the condition B from the start. For example, so-called fogging caused by the toner adhering to an underlying region or a white spot caused adhesion of a carrier mixed with the toner may occur.

SUMMARY

In view of the aforementioned problem, an object of the present invention is to provide an image forming apparatus capable of forming an image having image quality similar to that of a case where an operation condition for image formation does not switch even when the operation condition for image formation switches in the course of advancing to an image formation allowable state.

To achieve the abovementioned object, according to an aspect of the present invention, there is provided an image forming apparatus that forms an image on a sheet under an operation condition set depending on a sheet type, and the image forming apparatus reflecting one aspect of the present invention comprises a hardware processor that: detects whether the sheet type is any one of a plurality of assumed types on the basis of an output of a sensor provided in a conveyance path of the sheet; performs control such that an activation operation for forming the image under an interim condition, which is an operation condition corresponding to one of the plurality of assumed types, is performed before detecting the sheet type; determines whether or not a recovery operation for optimizing a state of image formation is performed before starting image formation under a determinate condition, which is an operation condition corresponding to the detected type, on the basis of a magnitude of a difference between the determinate condition and the interim condition when the sheet type is detected; performs control such that the recovery operation is performed when it is determined that the recovery operation is performed;

and performs control such that the image formation is performed under the determinate condition after the recovery operation is performed.

BRIEF DESCRIPTION OF THE DRAWINGS

The advantages and features provided by one or more embodiments of the invention will become more fully understood from the detailed description given hereinbelow and the appended drawings winch are given by way of illustration only, and thus are not intended as a definition of the limits of the present invention:

FIG. 4 is a diagram illustrating an exemplary data structure of tray information;

FIG. 5 is a diagram illustrating an exemplary condition setting table;

FIG. 6 is a diagram illustrating an exemplary determination table;

DETAILED DESCRIPTION OF EMBODIMENTS

Hereinafter, one or more embodiments of the present invention will be described with reference to the drawings. However, the scope of the invention is not limited to the disclosed embodiments.

Figure 1:
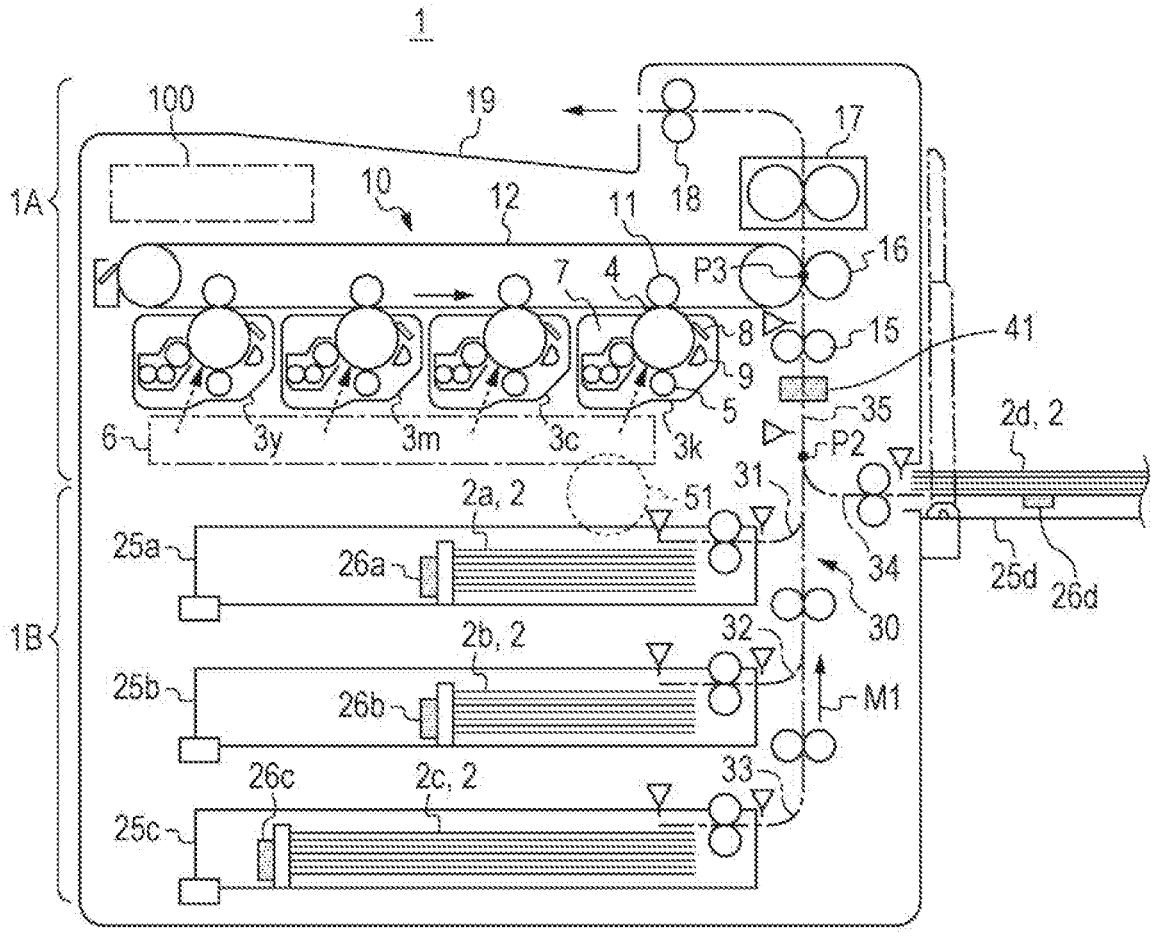
FIG. 1 is a diagram illustrating a schematic configuration of an image forming apparatus according to an embodiment of the present invention.
Figure 2:
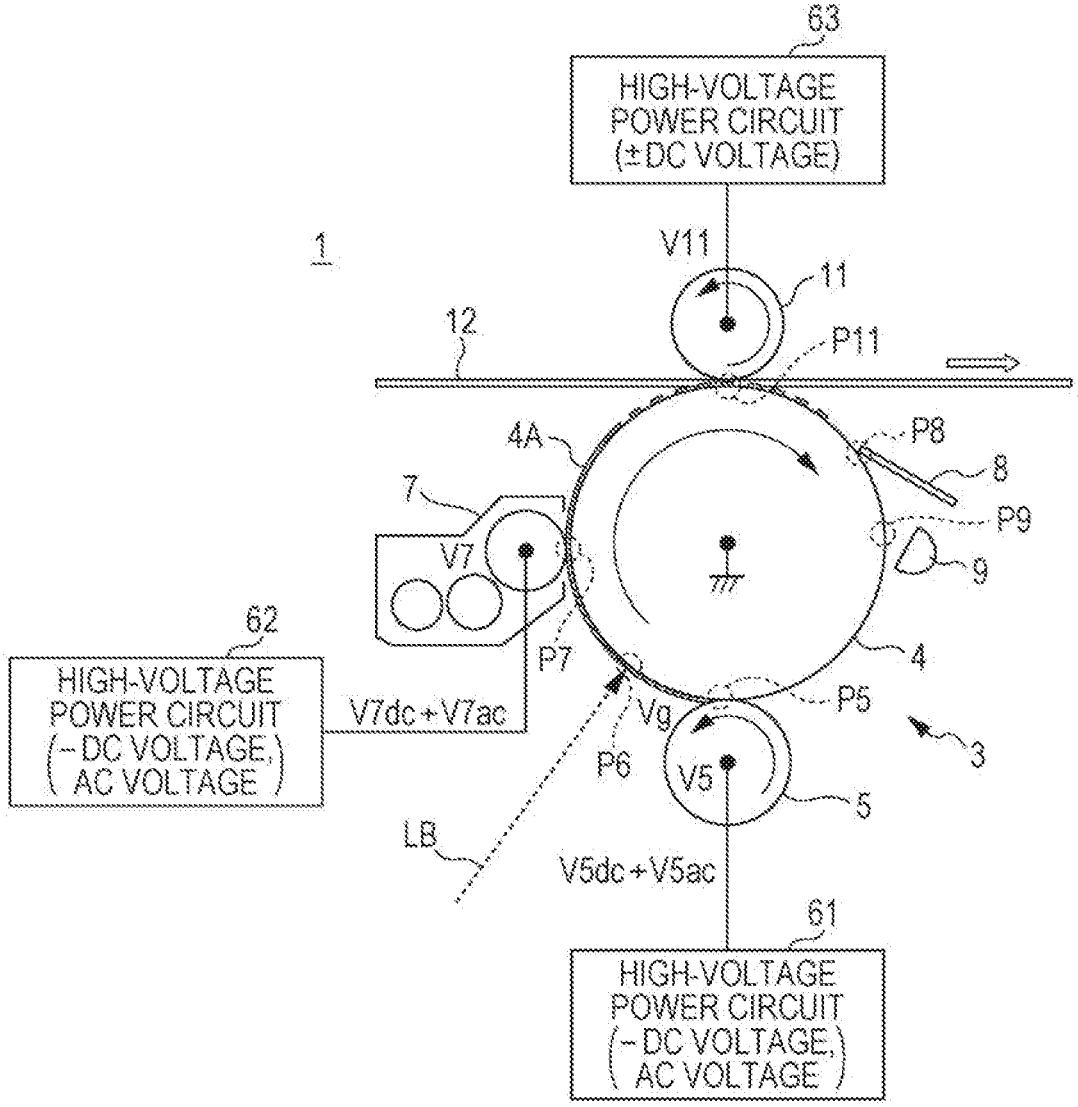
FIG. 2 is a diagram illustrating a configuration of an imaging unit.

FIG. 1 illustrates a schematic configuration of an image forming apparatus 1 according to an embodiment of the present invention, and FIG. 2 illustrates a configuration of an imaging unit 3.

In FIG. 1, the image forming apparatus 1 is a photoelectrographic color printer in which a tandem type printer engine 10 is disposed in an upper half portion 1A. The lower half portion 1B is a three-stage sheet cabinet having drawer type sheet feed trays 25*a*. 25*b*, and 25*c*. Furthermore, a manual tray 25*d* is provided in a right side face portion.

The image forming apparatus 1 forms a color or monochrome image depending on a job input from an external host device via a network. The image forming apparatus 1 has a control circuit 100 that controls its operation. The control circuit 100 includes a processor that executes a control program and its peripheral devices (such as a ROM or a RAM).

A printer engine 10 has four imaging units 3*y*, 3*m*, 3*c*, and 3*k*, a print head 6, and an intermediate transfer belt 12.

Imaging units 3*y* to 3*k* are units relating to a photosensing process for forming a toner image during an electrophotographic process. Each imaging unit has a cylindrical photoreceptor 4, an electrification roller 5, a developer 7, a cleaner 8, an eraser 9, or the like. Since the imaging units 3*y* to 3*k* have similar basic configurations, they will be collectively referred to as an "imaging unit 3" in the following description in some cases.

A print head 6 emits a laser beam for pattern exposure to each of the imaging units 3*y* to 3*k*. In the print head 6, main scanning is performed to deflect the laser beam along a rotation axis of the photoreceptor 4. In parallel with this main scanning, sub-scanning for rotating the photoreceptor 4 at a constant speed is performed.

An intermediate transfer belt 12 is a transfer target member in a primary transfer of a toner image, and is rotated while being looped around a pair of rollers. Primary transfer rollers 11 for each of the imaging units 3*y*, 3*m*, 3*c*, and 3*k* are disposed inside the intermediate transfer belt 12.

In a color print mode, the imaging units 3*y* to 3*k* form toner images of four colors including yellow (Y), magenta (M), cyan (C), and black (K) in parallel. The four color toner images are sequentially primarily transferred onto the rotating intermediate transfer belt 12. First, the toner image of "Y" is transferred, and the toner images of "M", "C", and "K" are sequentially transferred so as to overlap with the toner image "Y".

The primarily transferred toner image is secondarily transferred onto a sheet 2 extracted from any one of the sheet feed trays 25*a* to 25*c* or from the manual tray 25*d* and conveyed through a timing roller 15 in a print position P3 facing the secondary transfer roller 16. After the secondary transfer, the sheet passes through the inside of a fixer 17 and is conveyed by a discharging roller 18 to an upper sheet discharge tray 19. When the sheet passes through the fixer 17, the toner image is fixed to the sheet 2 by heating and pressing.

The image forming apparatus 1 has an imaging unit motor (IU motor) 51 provided as a driving source for the photoreceptor 4 and other rotating bodies in a single or a plurality of imaging units 3. This IU motor 51 also serves as a driving source for conveying the sheet 2. A rotational driving force of the IU motor 51 is transmitted to a pick-up roller that extracts the sheet 2 from each of a plurality of trays 25 and a timing roller 15 that temporarily stops the sheet 2 using a clutch.

In FIG. 2, the photoreceptor 4 is an image bearer for forming a latent image (electrostatic latent image) and is driven to rotate in one direction in synchronization with a drum as a support body.

The electrification roller 5 is a contact type electrification member and electrifies a circumferential surface of the photoreceptor 4 by rotating while coming into contact with the photoreceptor 4. A latent image of an image to be printed can be formed by performing pattern exposure for a part electrified uniformly on the circumferential surface of the photoreceptor 4 on the basis of the image data. The electrification roller 5 may be rotated to follow the photoreceptor 4 by virtue of friction with the photoreceptor 4 or may rotate at a circumferential speed matching that of the photoreceptor 4.

The developer 7 visualizes the latent image as a toner image by adhering the toner onto the circumferential surface of the photoreceptor. The developer 7 electrifies the toner, for example, by mixing the toner with a carrier and agitating them. In addition, the electrified toner is supplied to a development position P7 close to the photoreceptor 4.

The cleaner 8 is, for example, a blade type, in which a tip of the blade abuts in a cleaning position P8 in a downstream side with respect to a primary transfer position P11 along a rotation direction of the photoreceptor 4 to remove the residual toner or other adhered objects from the circumferential surface of the photoreceptor 4.

The eraser 9 irradiates light having a wavelength for reducing residual electric charges onto the circumferential surface of the photoreceptor 4 in the de-electrification position P9 in the downstream side of the cleaning position P8. An irradiation range of the light has a band shape having a length across the entire length of the rotation axis direction of the photoreceptor 4. Through this irradiation, the circumferential surface of the photoreceptor 4 in the irradiation position (de-electrification position) P9 is de-electrified. The eraser 9 has a light source and a feeding circuit for emitting light from the light source.

To form an image, an electrification bias V5 is applied to the electrification roller 5 by superimposing an AC voltage (electrification AC output V5*ac*) on a negative DC voltage (electrification DC output V5*dc*) using a high-voltage power circuit 61. That is, the electrification is performed using a so-called AC electrification method. The AC voltage has a frequency of, for example, 500 to 2,000 Hz.

An upstream side part of the surface of the rotating photoreceptor 4 with respect to the electrification roller 5, that is, a part moving toward the electrification roller 5 has a positive potential relative to a DC component (V5*dc*) of the electrification bias V5. As this part arrives at the vicinity of the upstream side of a nip portion with the electrification roller 5, electric discharge starts. The electrification becomes uniform by alternately switching the direction of the discharged current. The electric discharge becomes weakened as a distance from the nip portion increases, and finally, a negative charge corresponding to the electrification DC output V5*dc* is applied to the surface of the photoreceptor 4. That is, a surface potential of the photoreceptor 4 in the electrification position P5 in the downstream side of the nip portion becomes a negative side electrification potential Vg relative to a potential of the upstream side of the electrification position P5. This electrification potential Vg is adjusted by changing the electrification DC output V5*dc*.

In this manner, pattern exposure is performed for the electrified photoreceptor 4 using a laser beam LB from the print head 6 in the exposure position P6. The charges are partially lost by the pattern exposure to form a latent image. The latent image moves to the development position P7 as the photoreceptor 4 rotates.

A development bias V7 is applied to the developer 7 by superimposing an AC voltage (development AC output V7*ac*) on the negative DC voltage (development DC output V7*dc*) using the high-voltage power circuit 62. That is, so-called AC development is performed. By applying the DC voltage, the toner inside the developer 7 is negatively charged. The electrified toner is adhered to a dot of the photoreceptor 4 where electric charges are lost through the pattern exposure, so that the latent image is developed to the toner image. In this case, the AC component (V7*ac*) of the development bias V7 enhances a development capability by increasing the toner separated from the carrier and collecting the toner on the dot.

A positive or negative DC constant voltage (transfer output V11) is applied to the primary transfer roller 11 using the high-voltage power circuit 63. The transfer output V11 switches depending on a progression stage of the photosensing process. For example, in the primary transfer step, the transfer output V11 is set to a positive voltage in order to bias the primary transfer roller 11 into the transfer potential. By biasing the primary transfer roller 11 into a positive transfer potential, the negatively electrified toner image is attracted to the intermediate transfer belt 12. In addition, in a step of performing an activation operation (preparation operation) for advancing the imaging unit 3 to the image formation allowable state, the transfer output V11 is set to a negative voltage. That is, the primary transfer roller 11 is biased into a negative non-transfer potential. As a result, it is possible to prevent scattered toner from being adhered to the primary transfer roller 11.

Returning to FIG. 1, the upper sheet feed tray 25*a*, the middle sheet feed tray 25*b*, and the lower sheet feed tray 25*c* have the same basic configuration, and a plurality of sheets 2 (2*a*, 2*b*, and 2*c*) can be set on the sheet feed trays 25*a*, 25*b*, and 25*c*, respectively. The "set" means that the sheets are overlappingly placed on the sheet feed tray. The sheets 2*a* to 2*c* set on the sheet feed trays 25*a* to 25*c* may have the same size and the same type, or may have different sizes and different types.

Even when the sheets have the sane size, they may have different directions (set direction) with respect to the conveyance direction M1 in some cases. That is, in general, the sheet 2 has a rectangular shape having a long side and a short side. However, the sheet may be set in a so-called "vertical direction" in which the long side is set in parallel with the conveyance direction M1, or may be set in a so-called "horizontal direction" in which the long side is perpendicular to the conveyance direction M1.

The sheet feed trays 25*a* to 25*c* have size sensors 26*a*, 26*b*, and 26*c* for detecting the sizes and the directions of the sheets 2*a* to 2*c* set on the sheet feed trays 25*a* to 25*c*, respectively. Such size sensors 26*a* to 26*c* can detect the size and the direction at the timing prior to starting conveyance of the sheets 2*a* to 2*c*, respectively.

Note that the size sensors 26*a* to 26*c* may detect, as the sizes and the directions of the sheets 2*a* to 2*c*, positions of movable matching members arranged to come into contact with end edges of the sheets 2*a* to 2*c* in order to position the sheets 2*a* to 2*c*.

A plurality of sheets 2*d* may also be overlappingly set on the manual tray 25*d*. As long as the size is within an allowable range, the orientation may be either horizontal or vertical. The sheet 2*d* may be a long sheet that is not inserted into the sheet feed trays 25*a* to 25*c*.

A manual size sensor 26*d* for detecting the size and the orientation of the set sheet 2*d* is provided in the manual tray 25*d*.

Note that, in the following description, the sheet feed trays 25*a* to 25*c* and the manual tray 25*d* may be collectively referred to as a "tray 25".

A conveyance path 30 through which the sheet 2 passes inside the image forming apparatus 1 has sheet conveyance paths 31, 32, 33, and 34 corresponding to the four trays 25 and a common path 35. The sheet conveyance paths 31 to 34 are paths through which only the sheet 2 extracted from the corresponding tray 25 passes. In comparison, the common path 35 is a path through which all of the sheets 2*a*, 2*b*. 2*c*, and 2*d* set on different trays 25 pass, that is, a path common to the four trays 25. According to this embodiment, since the manual tray 25*d* is arranged over the upper sheet feed tray 25*a*, a path from a joining point P2 as a termination of the sheet conveyance path 34 to the discharging roller 18 is the common path 35. Note that a front-back inversion path for duplex print is not illustrated for simplicity purposes.

The image forming apparatus 1 has a sheet attribute sensor 41 for detecting the type of the sheet 2, and an image formation operation condition is set to obtain a suitable image depending on the detected type on the basis of the output of the sheet attribute sensor 41. The operation condition changed depending on the type of the sheet 2 includes a process speed (also referred to as a system speed) that defines conveyance of the sheet 2, rotation of the photoreceptor 4, or the like, an electrification bias, a transfer bias, a fixation temperature, or the like. The operation condition will be described below in more details.

The sheet attribute sensor 41 is arranged in an upstream side position with respect to the print position P3 in the middle of the common path 35, specifically, between the timing roller 15 and the joining point P2.

By arranging the sheet attribute sensor 41 in the common path 35, it is possible to detect the types of the sheets 2*a*, 2*b*, 2*c*, and 2*d* using a single sheet attribute sensor 41 regardless of the number of trays 25. Therefore, it is possible to achieve miniaturization and cost reduction by reducing the number of sensors.

In addition, by arranging the sheet attribute sensor 41 in the upstream side with respect to the timing roller 15, it is possible to secure a switching time by holding the sheet 2 in front of the print position P3 as necessary in a case where the print operation condition is switched after the type detection or the like.

The sheet attribute sensor 41 acquires information used in the type determination from the sheet 2. For example, the sheet attribute sensor 41 irradiates detection light onto the sheet 2 moving toward the timing roller 15 and acquires the received light amount of the detection light reflected on the surface of the sheet 2 as information for specifying smoothness of the sheet 2. In addition, the sheet attribute sensor 41 acquires the received light amount of the detection light transmitting through the sheet 2 as information for specifying the basis weight of the sheet 2. Furthermore, a detection signal representing such a received light amount is sent to the control circuit 100.

The control circuit 100 determines presence of a surface coat on the sheet 2 on the basis of the detection signal and specifies the basis weight to detect whether or not the type of the sheet 2 belongs to any one of a plurality of types (assumed types) classified by combining the presence of the surface coat and the basis weight.

Note that the sheet attribute sensor 41 is not limited to an optical sensor, but may include a displacement sensor for detecting a thickness of the sheet 2, a capacitance sensor for detecting a water content, a camera for imaging a surface of the sheet 2, an ultrasonic sensor for detecting overlapping, seams, steps, or the like, or a suitable combination of other sensors.

The image forming apparatus 1 selects any one of the trays 25 depending on a job when the input job starts to execute. For example, a tray 25 where a sheet 2 corresponding to an output image size designated by the job is set is selected. Alternatively, in a case where the tray 25 is designated by the job, the designated tray 25 is selected.

In a case where the type of the sheet 2 detected in advance is stored for the selected tray 25, that is, in a case where the type of the sheet 2 used in the image formation is determined, the operation condition corresponding to the stored type is set as an operation condition applied to the image formation. In addition, printing is performed by extracting the sheet 2 from the selected tray 25. In this case, the type detection based on the output of the sheet attribute sensor 41 is not performed.

Meanwhile, in a case where the type is not stored for the selected tray 25, that is, the type is not determined, the sheet 2 is extracted from the selected tray 25 and is conveyed to the timing roller 15. In the meantime, the type of the sleet 2 is detected on the basis of the output of the sheet attribute sensor 41. In addition, printing is performed by setting the operation condition corresponding to the detected type as an operation condition applied to the image formation. Note that, in a continuous print job, the type detection is performed for the first sheet 2, and the type detection is not performed for the second and subsequent sheets 2.

In a case where the type of the sheet 2 is detected, the activation operation is performed by assuming that a predetermined interim type of the sheet 2 is set on the selected tray 25. In addition, the type detection is performed in parallel with the activation operation. The interim type is one of a plurality of the assumed types as a detection target. In this activation operation, an operation condition corresponding to the interim type (referred to as "interim condition") is provisionally set as an operation condition applied to image formation.

By performing the type detection in parallel with the activation operation, it is possible to shorten the time until the first sheet 2 is discharged starting from the job (FPOT), compared to a case where the activation operation starts after the type detection.

Note that the interim type may be fixedly set or may be changed depending on user's designation.

As the type is detected, the operation condition applied to the image formation is determined. That is, the applied operation condition is determined as an operation condition corresponding to the detected type. In the following description, the operation condition corresponding to the type detected newly or in advance and stored may be referred to as "determinate condition" in some cases.

If the detected type matches the interim type, the image forming operation is performed subsequent to the activation operation without changing the setting of the operation condition. In comparison, if the detected type does not match the interim type, the image forming operation is performed by switching the setting of the operation condition from the interim condition to the determinate condition.

The image forming apparatus 1 has a control function for reducing influence to the image quality in a case where the setting of the operation condition is switched after the start of the activation operation. In the following description, a configuration and operations of the image forming apparatus 1 will be described by focusing on this control function.

Figure 3:
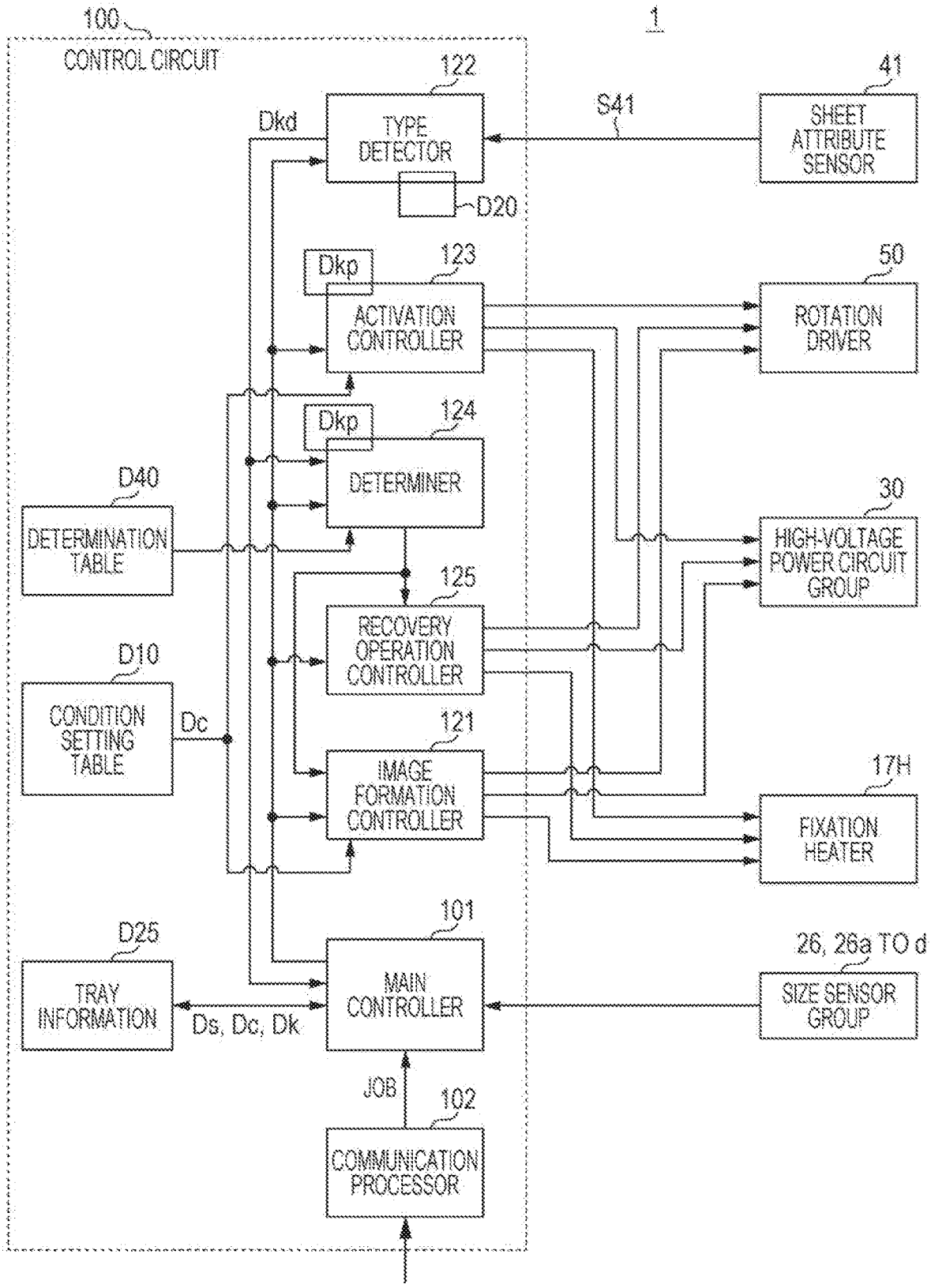
FIG. 3 is a diagram illustrating a functional configuration of a control circuit.

FIG. 3 illustrates a functional configuration of the control circuit 100. FIG. 4 illustrates an exemplary data structure of the tray information D25. FIG. 5 illustrates an exemplary condition setting table D10. FIG. 6 illustrates an exemplary determination table D40.

In FIG. 3, the control circuit 100 has a main controller 101, a communication processor 102, an image formation controller 121, a type detector 122, an activation controller 123, a determiner 124, a recovery operation controller 125, and the like. Such functions are implemented by a hardware configuration of the control circuit 100 including a central processing unit (CPU) as a control program is executed by the CPU.

The main controller 101 is a controller responsible for a whole control of the image forming apparatus 1. As a job is input by communication between the communication processor 102 and the host device, a command is issued from the main controller 101 to the image formation controller 121 or the like in order to perform printing as many as the number of sheets designated for that job.

The main controller 101 detects a size Ds and an orientation Dd of the sheet 2 set on each tray 25 using a size sensor group 26, that is, the size sensors 26*a* to 26*c* and the manual size sensor 26*d*. In addition, the detected size Ds and orientation Dd are stored as a part of the tray information D25.

As illustrated in FIG. 4, the tray information D25 includes the size Ds and the orientation Dd of the sheet 2 set on each tray 25 and the detected type Dk detected by the type detector 122. In the state of FIG. 4, the type Dk corresponding to the sheet feed tray 25*a* is set as "unknown". That is, the type Dk is not stored. This means that the type Dk is not detected after setting the sheet 2 on the sheet feed tray 25*a*, or the previous detection result is invalidated as it is determined that there is a possibility of replacement of the sheet 2 because a manipulation for extracting the sheet feed tray 25*a* is performed after the detection.

Note that the corresponding types Dk detected in advance are stored for the sheet feed trays 25*b* and 26*b* and the manual tray 25*d*.

Returning to FIG. 3, as a job is input, the main controller 101 selects a tray 25 suitable for the job as described above.

In a case where the type Dk is stored for the selected tray 25, it is instructed that the stored type Dk is notified to the activation controller 123 and the image formation controller 121, and a predetermined control is performed.

Meanwhile, in a case where the type Dk is not stored for the selected tray 25, it is instructed for the type detector 122 to detect the type Dk, and the detection of the type Dk is notified to the activation controller 123 and the image formation controller 121.

The activation controller 123 controls a rotation driver 50, a high-voltage power circuit group 30, or the like to perform the activation operation. The rotation driver 50 includes an IU motor 51, a clutch that transmits a rotation driving force of the IU motor 51, and the like. The high-voltage power circuit group 30 has high-voltage power circuits 31, 32, and 33. The activation operation will be described below in details.

In a case where the type Dk is notified from the main controller 101, the activation controller 123 reads an operation condition value Dc corresponding to the notified type Dk from the condition setting table D10, and performs a control for the activation operation to form an image using the read operation condition value Dc.

In a case where the detection of the type Dk is notified from the main controller 101, the activation controller 123 performs a control for the activation operation for forming an image using an interim condition Dkp before the type Dk of the sheet 2 is detected.

The condition setting table D10 contains operation condition values Dc corresponding each of a plurality of assumed types Dk as illustrated in FIG. 5 as control information representing the operation condition to be set depending on the type Dk of the sheet 2.

According to this embodiment, the sheet 2 is classified into seven sheet types (thin sheet, plain sheet, thick sheet 1, thick sheet 2, thick sheet 3, thick sheet 4, and thick sheet 5) depending on a basis weight, and is classified into uncoated (A) and coated (B) depending on smoothness of the surface. That is, fourteen types Dk are assumed, including thin sheet A, thin sheet B, plain sheet A, plain sheet B, thick sheet 1A, thick sheet 1B, thick sheet 2A, thick sheet 2B, thick sheet 3A, thick sheet 3B, thick sheet 4A, thick sheet 4B, thick sheet 5A, and thick sheet 5B.

For each of the fourteen types Dk, operation condition values Dc such as a process speed (image formation speed) Vs, a fogging margin Vm, a fixation temperature (fixation setting temperature) Ts, and a secondary transfer output V16 are associated.

The process speed Vs is a condition for defining a conveyance speed of the sheet 2 in the secondary transfer and the fixation, a circumferential speed of the photoreceptor 4, a movement speed of the intermediate transfer belt 12, or the like. In the example of FIG. 5, the process speeds Vs of the thick sheet and the plain sheet are set to 290 mm/s which is the fastest, and the process speeds Vs of the thick sheets 1 to 3 are set to 210 mm/s which is the next fastest. In addition, the process speeds Vs of the thick sheets 4 and 5 are set to 105 mm/s which are the slowest.

The fogging margin Vm is a condition for preventing fogging and refers to a difference between the electrification potential Vg of the photoreceptor 4 and the development DC output V7*dc*. According to this embodiment, since the development DC output V7*dc* is fixed, the fogging margin Vm is a condition for defining the electrification potential Vg. The fogging margin Vm is adjusted by controlling the electrification DC output V5*dc* that substantially determines the electrification potential Vg.

The fixation temperature Ts is a heating temperature using a fixation heater 17H of the fixer 17, and the secondary transfer output V16 is an output voltage of the high-voltage power circuit that biases the secondary transfer roller 16.

Out of the fourteen types Dk of the condition setting table D10, for example, the thick sheet 5A is set as the interim type Dkp. This thick sheet 5A is one of the type groups having the slowest process speed Vs. That is, the interim condition set provisionally to detect the type Dk is set as an operation condition having the slowest process speed Vs.

By delaying the process speed Vs when the type Dk is detected, the time that the sheet 2 passes through the detectable range of the sheet attribute sensor 41 increases. Therefore, since the frequency of detection performed during a control period increases, detection accuracy is improved. In addition, it is possible to prevent a jamming that may easily occur when the sheet 2 to be conveyed slowly is conveyed fast.

However, any type other than the type having the slowest process speed Vs may be set as the interim type Dkp. For example, the type Dk of the sheet 2 most frequently used by a user may be set as the interim type Dkp depending on user's designation or a past use record.

Returning to FIG. 3, the type detector 122 detects the type Dk of the sheet 2 extracted from the tray 25 and conveyed to the common path 35 on the basis of the detection signal S41 output from the sheet attribute sensor 41. Specifically, as a detection command is received from the main controller 101, the detection signal S41 is obtained at a predetermined suitable timing, and the type Dkd corresponding to the value of the detection signal S41 is acquired as a detection result from the determination information D20 that associates the detection signal S41 with the fourteen types Dk. That is, it is detected whether or not the type Dk of the sheet 2 is one of the fourteen types Dk. In addition, the type Dkd detected in this manner is notified to the determiner 124 and the main controller 101.

As the detected type Dkd is notified, the determiner 124 determines whether or not the recovery operation for optimizing the image formation state is performed before starting image formation under the determinate condition on the basis of a magnitude of a difference between the interim condition and the determinate condition which is an operation condition corresponding to the detected type Dkd. Specifically, the processing is performed as follow.

In a case where the detected type Dkd is different from the interim type Dkp, it is necessary to switch the operation condition until image formation starts from the start of the activation operation. Ideally, a plurality of operation condition values Dc as the operation conditions are switched at once. However, in practice, since the operating environment of the image forming apparatus 1, the output characteristic of the control circuit 100, the electrification characteristic of the photoreceptor 4, or the like are involved, a deviation occurs in the switching timing between the operation condition values Dc in some cases.

For example, in a case where a change of the fogging margin Vm does not follow a change of the process speed Vs, the fogging margin Vm for image formation is set to be small. This generates fogging. Inversely, in a case where a change of the process speed Vs does not follow a change of the fogging margin Vm, carrier adhesion may occur.

In this regard, in determination of the determiner 124, attention is paid to the process speed Vs and the fogging margin Vm relating to the photosensing process out of the operation condition values Dc of FIG. 5.

Between the interim type Dkp and the detected type Dkd, it is determined whether or not a difference of the process speed Vs is zero (equal), whether or not the difference is smaller than a threshold value (thΔVs), or whether or not the difference is larger than the threshold value (thΔVs). That is, when the setting of the operation condition is switched from the interim condition to the determinate condition, it is determined whether or not there is a change in the process speed Vs, whether or not the change amount is small in the case of a change, or whether or not the change amount is large.

Similarly, for the fogging margin Vm, when the setting is switched from the interim condition to the determinate condition, it is determined whether or not there is a change, whether or not the change amount is smaller than the threshold value (thΔVm), or whether or not the change amount is larger than the threshold value (thΔVm).

The determiner 124 determines whether or not the recovery operation is performed with reference to the determination table D40 on the basis of a determination result for the process speed Vs and a determination result for the fogging margin Vm.

As illustrated in FIG. 6, referring to the determination table D40, the detected type Dkd is classified into nine groups including a group A and groups Ba to Bh. In addition, whether or not the recovery operation is necessary, the recovery operation to be performed, and the operation after the type detection are specified for each group.

The group A is a group having no change in the process speed Vs and no change in the fogging margin Vm. If the detected type Dkd belongs to the group A, it is specified that the recovery operation is not necessary.

The groups Ba to Bh are groups in which at least one of the process speed Vs and the fogging margin Vm are changed.

The group Ba is a group having no change in the process speed Vs but having a small change amount in the fogging margin Vm. Even when the detected type Dkd belongs to the group Ba, it is specified that the recovery operation is not necessary.

The group Bb is a group having no change in the process speed Vs but having a significant change amount in the fogging margin Vm. If the detected type Dkd belongs to the group Bb, it is specified that it is necessary to perform an idling operation as the recovery operation.

The idling operation is an operation for rotating the photoreceptor 4 such that the region 4A of the photoreceptor 4 electrified through the activation operation (see FIG. 2) is de-electrified while the primary transfer roller 11 is maintained at a non-transfer potential. That is, a rear end of the region 4A (the end edge of the upstream side in the rotation direction) is moved until it passes through at least the de-electrification position P9 from the electrification position P5.

By performing the idling operation, even when the state of the photoreceptor 4 is disturbed by switching the operation condition, and the toner or the carrier adheres, such an adhered object is not transferred onto the intermediate transfer belt 12, but is removed by the cleaner 8 in the cleaning position P8 in the upstream side of the de-electrification position P9. Note that, in the image forming operation subsequent to the idling operation, the photoreceptor 4 subjected to de-electrification is electrified under the determinate condition.

The group Bc is a group having a small change amount in the process speed Vs and having no change in the fogging margin Vm. If the detected type Dkd belongs to the group Bc, it is specified that the recovery operation is not necessary.

The group Bd is a group having a small change amount in the process speed Vs and having a small change amount in the fogging margin Vm. Even when the detected type Dkd belongs to the group Bd, it is specified that the recovery operation is not necessary.

The group Be is a group having a small change amount in the process speed Vs and having a large change amount in the fogging margin Vm. If the detected type Dkd belongs to the group Be, it is specified that it is necessary to perform a deactivation operation as the recovery operation.

The deactivation operation is an operation for returning the photoreceptor 4 to a state immediately before starting the activation operation under the interim condition. In the deactivation operation, the electrification roller 5, the developer 7, and the eraser 9 are temporarily turned off. Note that, subsequent to this deactivation operation, a re-activation operation for forming an image under the determinate condition will be performed.

The group Bf is a group having a large change amount in the process speed Vs but having no change at least in the fogging margin Vm. If the detected type Dkd belongs to the group Bf, it is specified that it is necessary to perform the idling operation as the recovery operation.

The group Bg is a group having a large change amount in the process speed Vs and having a small change amount in the fogging margin Vm. If the detected type Dkd belongs to the group Bg, it is specified that it is necessary to perform the idling operation as the recovery operation.

The group Bh is a group having a large change amount in the process speed Vs and having a large change amount in the fogging margin Vm. If the detected type Dkd belongs to the group Bh, it is specified that it is necessary to perform the deactivation operation as the recovery operation.

In the determination based on the determination table D40, the threshold value thΔVs of the change amount of the process speed Vs is set to, for example, 110 [mm/s], and the threshold value thΔVm of the change amount of the fogging margin Vm is set to, for example, 40 [V], whether the recovery operation is necessary or unnecessary is determined as follows.

Referring to FIG. 5, in a case where the interim type Dkp is defined as "thick sheet 5A", and the detected type Dkd is "thin sheet A" or "plain sheet A", it is determined that it is necessary to perform the idling operation as the recovery operation. In addition, if the detected type Dkd is "thin sheet B" or "plain sheet B", it is determined that it is necessary to perform the deactivation operation as the recovery operation. If the detected type Dkd is any one of other types Dk (such as thick sheet 1A or 1B, thick sheet 2A or 2B, thick sheet 3A or 3B, thick sheet 4A or 4B, or thick sheet 5A or 5B), it is determined that it is not necessary to perform the recovery operation.

In a case where the interim type Dkp is defined as "plain sheet A", and the detected type Dkd is "thick sheet 4A", "thick sheet 4B", "thick sheet 5A", or "thick sheet 5B", it is determined that it is necessary to perform the idling operation as the recovery operation. In the case of other types Dk (such as thick sheet, plain sheet, and thick sheets 1 to 3), it is determined that it is not necessary to perform the recovery operation.

Figure 7:
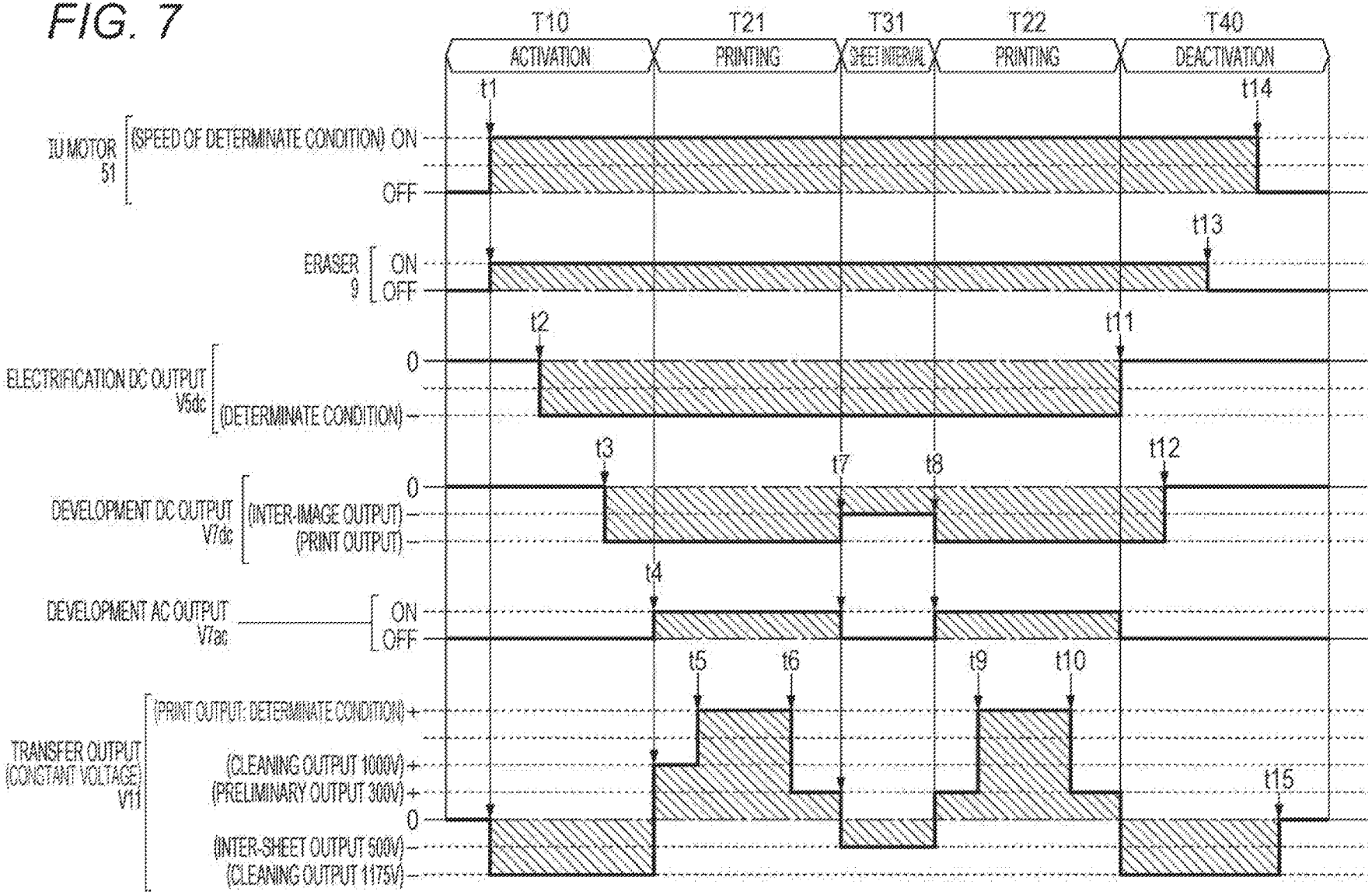
FIG. 7 is a diagram illustrating an exemplary control for a case where type detection is not performed.
Figure 8:
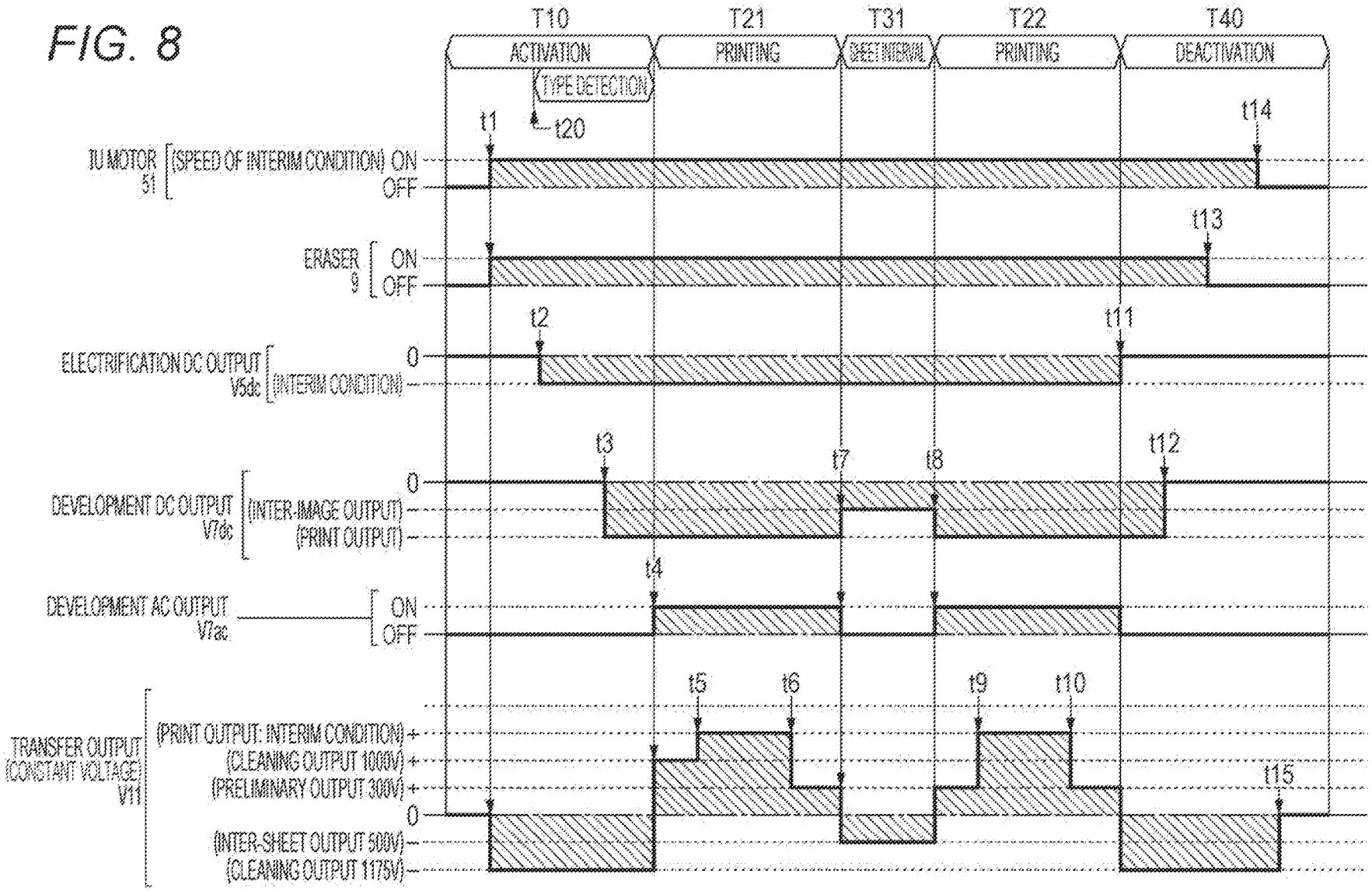
FIG. 8 is a diagram illustrating a first exemplary control for a case where type detection is performed.
Figure 9:
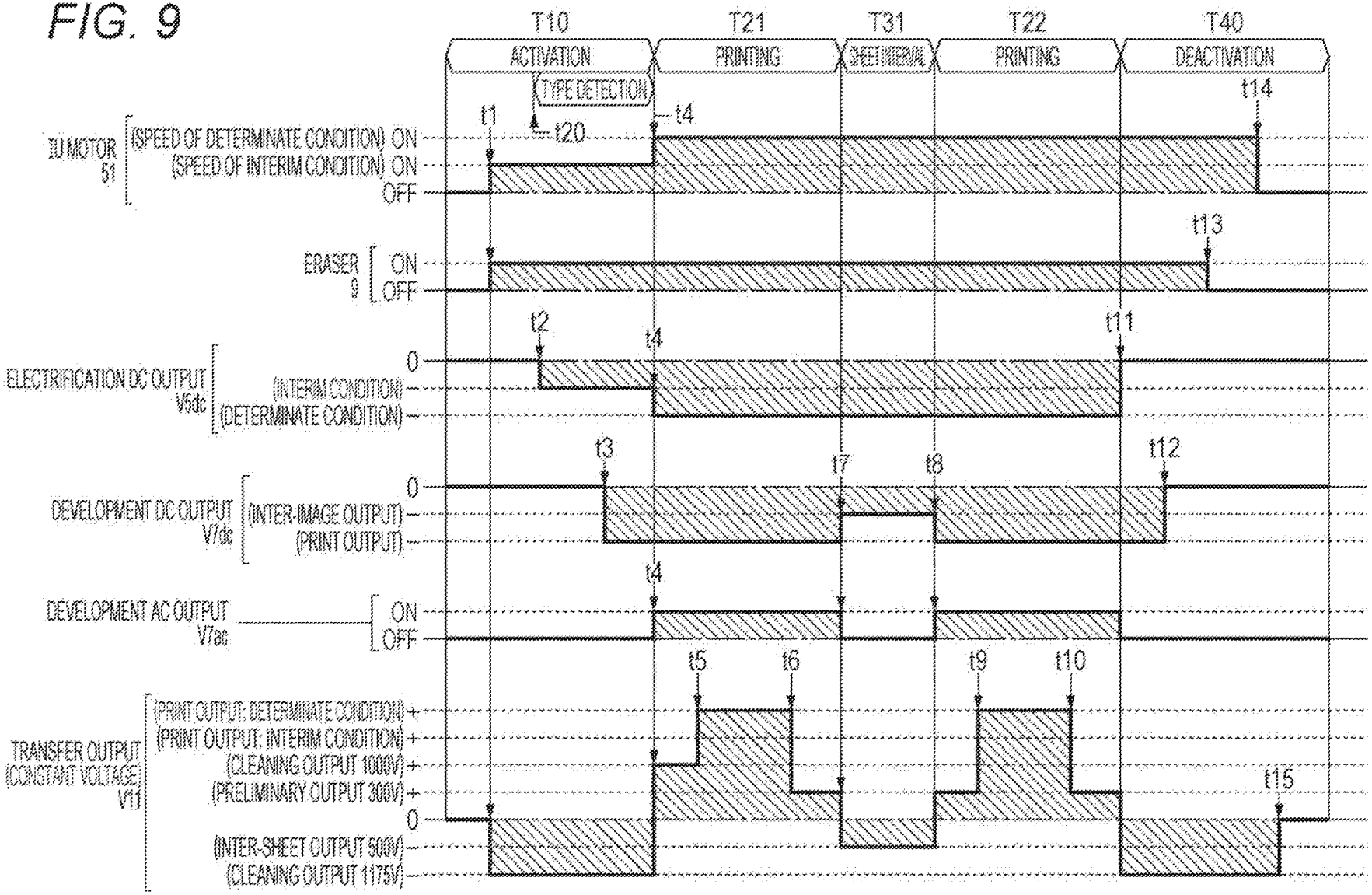
FIG. 9 is a diagram illustrating a second exemplary control for a case where type detection is performed.
Figure 10:
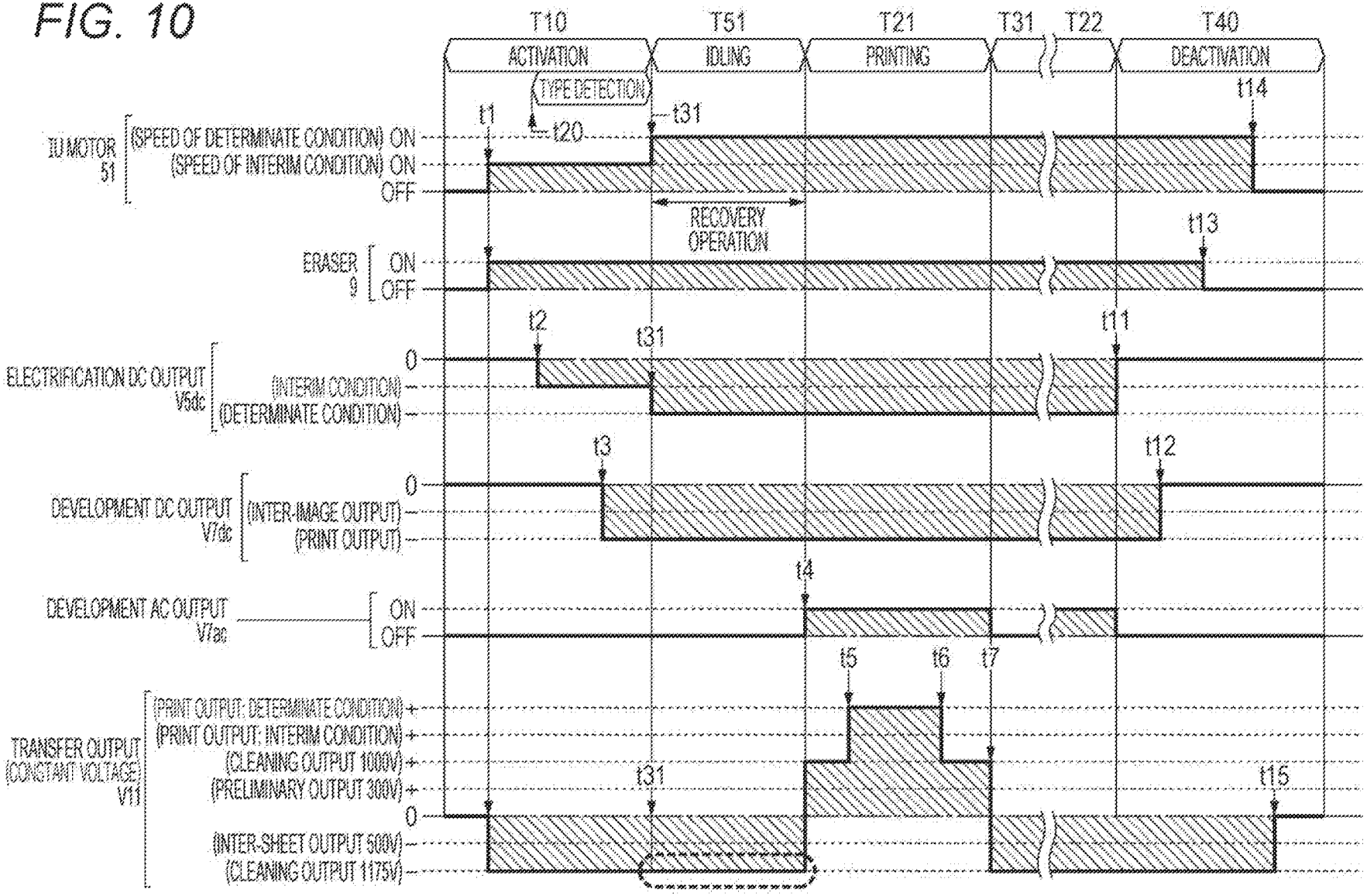
FIG. 10 is a diagram illustrating a third exemplary control for a case where type detection is performed.
Figure 11:
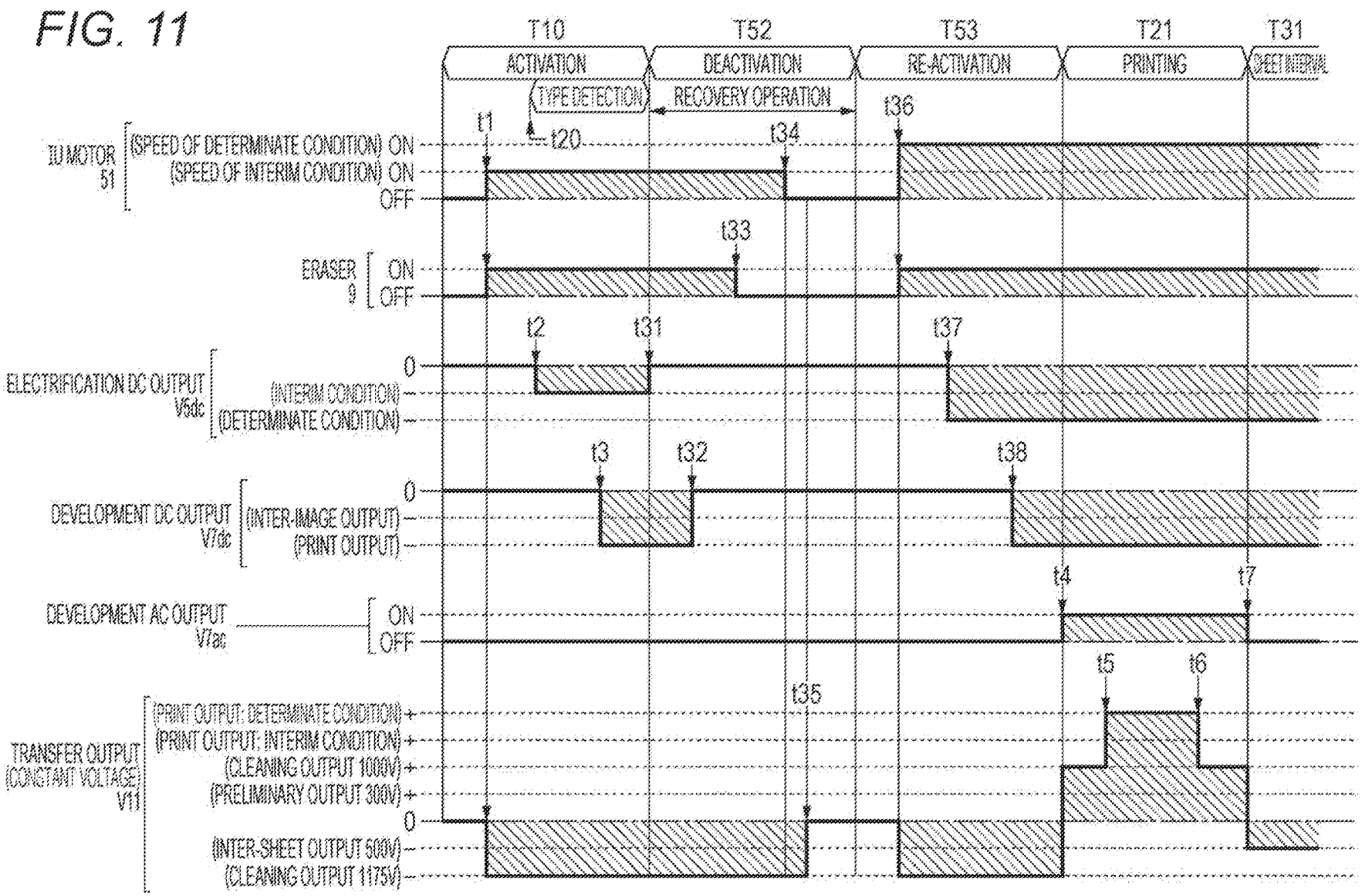
FIG. 11 is a diagram illustrating a fourth exemplary control for a case where type detection is performed.

FIG. 7 illustrates an exemplary control for a case where the type detection is not performed. FIG. 8 illustrates a first exemplary control for a case where the type detection is performed. FIG. 9 illustrates a second exemplary control. FIG. 10 illustrates a third exemplary control. FIG. 11 illustrates a fourth exemplary control. In the examples of FIGS. 7 to 11, it is assumed that a continuous print job for forming images on one surface of each of two sheets 2 is executed. The two sheets 2 are conveyed to pass through the print position P3 continuously with a predetermined gap (so-called sheet interval), and the photosensing process is performed by matching the timing with that. In addition, in the examples of FIGS. 8 to 11, it is assumed that the interim type Dkp is the thick sheet 5A.

In the continuous print job assumed as an example, the progress of the photosensing process basically starts from an activation step T10 as illustrated in FIG. 7. Then, the photosensing process is performed in order of a first print step (printing) T21, a sheet separation step T31, a second print step (printing) T22, and a deactivation step T40.

In a case where the type Dk is stored for the tray 25 selected depending on a job, the image forming apparatus 1 is controlled to form an image under the operation condition (determinate condition) corresponding to the type Dk as illustrated in the example of FIG. 7.

That is, as a job is input, at the timing t1, the IU motor 51 is turned on, and the photoreceptor 4 is rotated at the process speed Vs corresponding to the stored type Dk. In addition as the eraser 9 is turned on, the transfer output V11 is set to a negative cleaning output in order to prevent the transfer portion from being dirt.

At the timing t2 after the rotation of the photoreceptor 4 is stabilized, the electrification DC output V5*dc* is turned on. At the timing t3 at which the electrified region of the photoreceptor 4 reaches the development position P7, the development DC output V7*dc* is set as a print output that enables development. As a result, preparation of the image formation is completed. A series of the flow from the turn-on of the IU motor 51 to the turn-on of the development DC output V7*dc* is the activation operation of the photographing process. In the activation operation, the exposure using the print head 6 is not performed.

At the timing t4 in which formation of a latent image starts, the development AC output V7*ac* is turned on, and the transfer output V11 is set as a positive cleaning output. During the timing t5 to t6 in which a latent image passes through the transfer position P11, the transfer output V11 is set as a positive print output, and the primary transfer roller 11 is biases to the transfer potential. At the timing t6, the transfer output V11 is set as a positive preliminary output.

During the timing t7 to 18 in which a standby state is set until formation of the next latent image, the development AC output V7*ac* is turned off. In addition, the development DC output V7*dc* is set as an inter-image output, and the transfer output V11 is set as a negative inter-sheet output.

At the timing t8 in which formation of the second latent image starts, the development AC output V7*ac* is turned on again, and the development DC output V7*dc* is set as a print output. During the timing t9 to 10 in which a latent image passes through the transfer position P11, the transfer output V11 is set as a print output.

At the timing t11 after the primary transfer is completed, the development AC output V7*ac* is turned off, and the electrification DC output V5*dc* is turned off. Then, the development DC output V7*dc*, the eraser 9, the IU motor 51, and the transfer output V11 are sequentially turned off (t12, t13, t14, and t15).

In the example of FIG. 8, since the type Dk is not stored for the selected tray 25, detection of the type Dk is performed. However, since the detected type Dkd is identical to the interim type Dkp, an image is formed without changing the operation condition after the start of the activation operation.

The control of the example of FIG. 8 is similar to the control of the example of FIG. 7. However, the interim type Dkp of the example of FIG. 8 is different from the type Dk of the sheet 2 of the example of FIG. 7. For this reason, in FIG. 8, the electrification DC output V5*dc* of the timings t1 to t1 and the transfer output V11 of the timings t5 to t6 and t9 to t10 are different from those of the examples of FIGS. 7 and 8.

In the example of FIG. 8, type detection is performed from the timing t20 in which the sheet 2 arrives at the detection position in parallel with the activation operation.

In the example of FIG. 9, similar to the example of FIG. 8, the type Dk is detected, and an image is formed by switching the operation condition after starting the activation operation because the detected type Dkd is different from the interim type Dkp. It is determined that it is not necessary to perform the recovery operation when the operation condition is switched. Therefore, an image is formed without performing the recovery operation.

In FIG. 9, at the timing t14, the rotation speed of the IU motor 51 and the electrification DC output V5*dc* are switched from the interim condition to the determinate condition unlike FIG. 8. In addition, at the timings t5 to t6 and t9 to t10, the transfer output V11 is set as the determinate condition.

In the example of FIG. 10, similar to the example of FIG. 9, since the type Dk is not stored for the selected tray 25, the type Dk is detected. The detected type Dkd is different from the interim type Dkp. The idling operation is performed as the recovery operation, and an image is then formed.

In FIG. 10, an idling step T51 is inserted between the activation step T10 and the print step T21 of the first sheet.

At the timing t31 in which it is determined that it is necessary to perform the recovery operation by detecting the type Dk, similar to the case of the timing t4, the rotation speed of the IU motor 51 and the electrification DC output V5*de* are switched from the interim condition to the determinate condition in the example of FIG. 8.

However, as illustrated in the dotted box of FIG. 10, the transfer output V11 is not switched at the timing t31, but is continuously maintained at the cleaning output until completion of the idling step T51 from the activation step T10. As a result, in the idling step T51, the primary transfer roller 11 is set as a non-transfer potential.

Note that the IU motor 51, the eraser 9, the electrification DC output V5*dc*, and the development DC output V7*dc* in the idling step T51 are controlled to the same states as those of the print steps T21 and T22. As a result, it is possible to accelerate the transition from the idling step T51 to the print step T21. In addition, a control subsequent to the timing t4 after the idling operation is similar to the control of the example of FIG. 9.

In the example of FIG. 11, similar to the example of FIG. 10, the type Dk is detected. The detected type Dkd is different from the interim type Dkp. As the recovery operation, the deactivation operation is performed instead of the idling operation. Then, the re-activation operation is performed to form an image.

In FIG. 11, the deactivation step T52 and the re-activation step T53 are inserted between the activation step T10 and the print step T21 of the first sheet.

At the timing t31, the electrification DC output V5*dc* is turned off. Then, the development DC output V7*dc*, the eraser 9, the IU motor 51, and the transfer output V11 are sequentially turned off (t32, t33, t34, and t35). Such a series of the flow serves as the deactivation operation as the recovery operation.

At the timing t36 subsequent to the timing t35, the IU motor 51 is turned on, and the photoreceptor 4 is rotated at the process speed Vs of the determinate condition. In addition, the eraser 9 is turned on, and the transfer output V11 is set as the negative cleaning output.

At the timing t37 after rotation of the photoreceptor 4 is stabilized, the electrification DC output V5*dc* is turned on. At the timing t38 in which the electrified region of the photoreceptor 4 arrives at the development position P7, the development DC output V7*dc* is set as a print output. As a result, preparation of the image formation under the determinate condition is completed. A series of the flow from the turn-on of the IU motor 51 to the turn-on of the development DC output V7*dc* is the re-activation operation of the photosensing process. The control subsequent to the timing t4 after completion of the re-activation operation is similar to the control of the example of FIG. 9.

Figure 12:
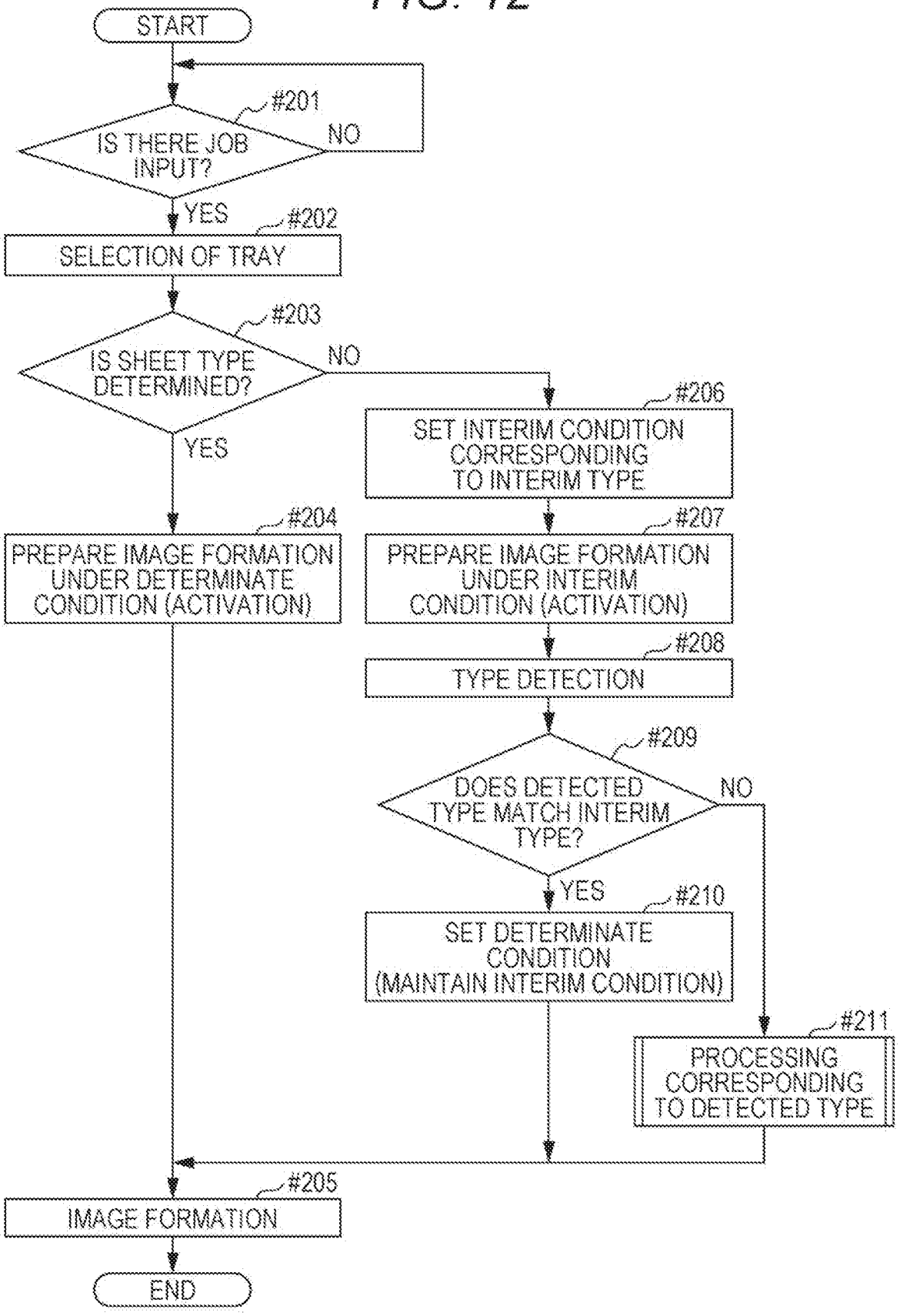
FIG. 12 is a diagram illustrating a processing flow in the image forming apparatus.
Figure 13:
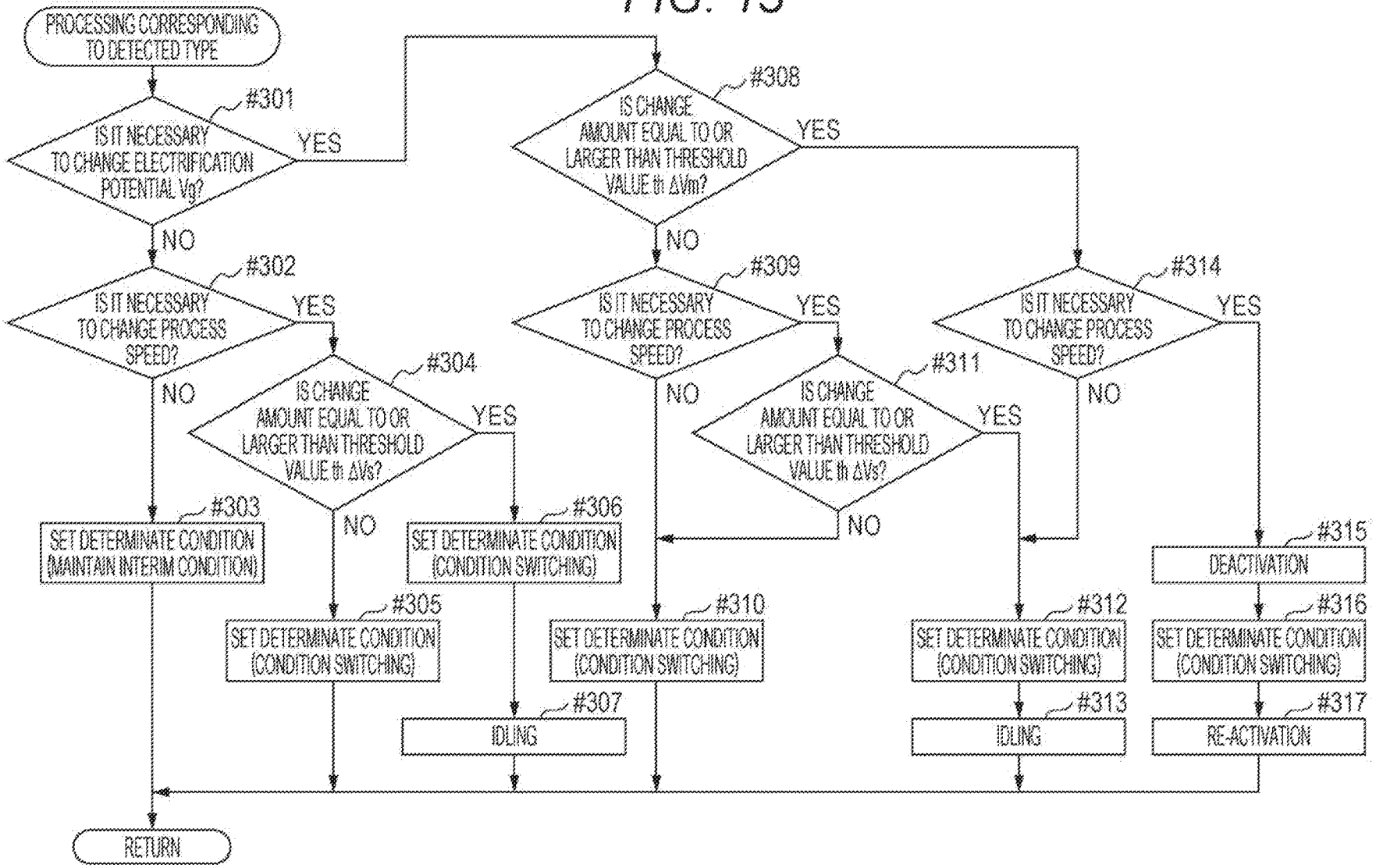
FIG. 13 is a diagram illustrating a processing flow depending on a detected type.

FIG. 12 illustrates a process flow of the image forming apparatus 1. FIG. 13 illustrates a process flow depending on the detected type.

In FIG. 12, the image forming apparatus 1 waits for a job input (#201). As a job is input (YES in #201), the tray 25 is selected by referencing the tray information D25 (#202), and it is checked whether or not the type Dk of the sheet 2 to be used is determined (#203). That is, it is checked whether or not the type Dk is stored in the selected tray 25.

If the type Dk is determined (YES in #203), preparation for image formation under the determinate condition (activation operation) is performed (#204), and the image formation is performed (#205).

If the type Dk is not determined (NO in #203), the interim condition corresponding to the interim type Dkp is provisionally set as the operation condition applied to the image formation (#206), and preparation for image formation under the interim condition starts (#207).

The type Dk is detected in parallel with the preparation for image formation (#208), and the detected type Dkd and the interim type Dkp are compared (#209).

If the detected type Dkd and the interim type Dkp match each other (YES in #209), the determinate condition is set as the operation condition applied to image formation (#210). This means that the provisionally set operation condition is maintained as the operation condition applied to image formation. After the operation condition is set, image formation is performed (#205).

If the detected type Dkd and the interim type Dkp do not match each other (NO in #209), "a processing corresponding to the detected type" including determination on whether or not the recovery operation is necessary is performed (#211), and the image formation is then performed (#205).

In FIG. 13, it is checked whether or not a change of the electrification potential Vg is necessary, that is, whether or not the fogging margin Vm corresponding the detected type Dkd and the fogging margin Vm corresponding to the interim type Dkp match each other (#301).

If a change of the electrification potential Vg is not necessary (NO in #301), it is subsequently checked whether or not a change of the process speed Vs is necessary (#302).

If a change of the process speed Vs is not necessary (NO in #302), the setting of the operation condition as the interim condition is maintained (#303), and the process returns to the flow of FIG. 12.

If a change of the process speed Vs is necessary (YES in #302), it is determined whether or not the change amount is equal to or larger than the threshold value thΔVs (#304). If the change amount is not equal to or larger than the threshold value thΔVs (NO in #304), the setting of the operation condition as the interim condition is maintained (#305).

If the change amount of the process speed Vs is equal to or larger than the threshold value thΔVs (YES in #304), the setting of the operation condition is switched from the interim condition to the determinate condition (#306), and the idling operation is performed (#307).

If a change of the electrification potential Vg is necessary (YES in #301), it is determined whether or not the change amount is equal to or larger than the threshold value thΔVm (#308).

If the change amount of the electrification potential Vg is not equal to or larger than the threshold value thΔVm (NO in #308), it is subsequently checked whether or not a change of the process speed Vs is necessary (#309).

If a change of the process speed Vs is not necessary (NO in #309), the setting of the operation condition as the interim condition is maintained (#310).

If a change of the process speed Vs is necessary (YES in #309), it is determined whether or not the change amount is equal to or larger than the threshold value thΔVs (#311).

If the change amount of the process speed Vs is not equal to or larger than the threshold value thΔVs (NO in #311), the setting of the operation condition as the interim condition is maintained (#310). If the change amount is equal to or larger than the threshold value thΔVs (YES in #311), the setting of the operation condition is switched from the interim condition to the determinate condition (#312), and the idling operation is performed (#313).

Even when the change amount of the electrification potential Vg is equal to or larger than the threshold value thΔVm (YES in #308), it is checked whether or not a change of the process speed Vs is necessary (#314).

If a change of the process speed Vs is not changed (NO in #314), the setting of the operation condition is switched from the interim condition to the determinate condition (#312), and the idling operation is performed (#313).

If a change of the process speed Vs is necessary (YES in #314), the deactivation operation is performed (#315), and the setting of the operation condition is then switched from the interim condition to the determinate condition (#316). In addition, the re-activation operation is performed (#317).

According to the aforementioned embodiment, the recovery operation for reducing degradation of image quality caused by switching of the operation condition is performed as necessary. Therefore, even when the operation condition for the image formation switches in the course of advancing to the image formation allowable state, it is possible to form an image having image quality similar to that of a case where the operation condition for image formation does not switch.

Even when the operation condition is switched, the recovery operation is not performed if it is determined that influence of the switching is insignificant. Therefore, it is possible to secure productivity similar to that of a case where the operation condition is not switched.

In the embodiment described above, when it is determined whether or not the recovery operation is necessary, the electrification potential Vg is first checked, and the process speed Vs is checked subsequently, so that a deviation between the interim condition and the determinate condition is checked. However, the sequence of the checking is not limited thereto. The process speed Vs may be checked first, and the electrification potential Vg may be checked subsequently.

The recovery operation is not limited to an operation for preventing a white spot caused by fogging or adhesion of the carrier, that is, an operation for reducing influence of switching of the operation condition mainly for the photosensing process. Influence on the switching of the operation condition for the secondary transfer process or the fixing process may also be reduced. In addition, influence on a combination of a plurality of processes may also be reduced.

In a case where the process speed Vs, the fixation temperature (fixation setting temperature) Ts. and the secondary transfer output V16 are set depending on the type Dk classified on the basis of the basis weight and the smoothness as illustrated in FIG. 5, the following influence may occur.

That is, if the secondary transfer output V16 is short with respect to the process speed Vs, the image quality is degraded, or irregularity (also referred to as granularity or roughness) is generated in the image. Inversely, if the secondary transfer output V16 becomes excessive, a white spot on the image is generated.

If the fixation temperature Ts is short with respect to the process speed Vs, image gloss is degraded, or an image offset occurs, in which the toner image is partially adhered to the heating roller. Inversely, if the fixation temperature Ts becomes excessive, the sheet 2 may curl, or a fixing separation failure may occur.

As an example of the recovery operation for reducing such influences, idling of the intermediate transfer belt 12 may be performed. Although this operation is similar to the idling of the photoreceptor 4, the image formation does not start immediately after switching the operation condition, and time for rotating the intermediate transfer belt 12 is prepared. As a result, it is possible to perform the secondary transfer and the fixation while the secondary transfer output V16 and the fixation temperature Ts are stabilized. In addition, it is possible to prevent a foreign object (such as carrier toner, and paper powder) adhered to the intermediate transfer belt 12 from moving to the sheet 2 during the activation operation of the photosensing process. The foreign object can be recovered using the cleaner used to clean the intermediate transfer belt 12.

The recovery operation may also be performed for a deviation of the fixing process condition as well as the deviation of the photosensing process condition caused by a difference of the type Dk. As an example of this recovery operation, a change of the setting of the fixation temperature Vs may be performed.

That is, when the operation condition is switched, the temperature is changed to be higher or lower than the fixation temperature Vs of the determinate condition, and is then changed to the fixation temperature Vs of the determinate condition. That is, a temperature adjustment control for approaching the fixation temperature Vs different from the temperatures of the interim condition and the determinate condition is inserted between a temperature adjustment control for approaching the temperature of the interim condition and a temperature adjustment control for approaching the temperature of the determinate condition. As a result, it is possible to smoothen a change of the fixation temperature Vs from the start of the activation operation to the start of the image formation and eliminate a trouble in the fixing process.

For example, in a case where the temperature Tsp of the interim condition is higher than the temperature Tsd of the determinate condition, the operation condition may be switched in a stage having a temperature lower than the temperature Tsd in the middle of heating to the temperature Tsp during the activation operation. If the temperature control target is abruptly changed from the temperature Tsp to the temperature Tsd when the operation condition is changed, an overshoot may occur, in which the temperature decreases to the temperature Tsd after exceeding the temperature Tsd. An increase of the temperature becomes gentle by selecting the temperature control target as a temperature lower than the temperature Tsd. A change of the temperature can be monotonically approaches the temperature Tsd without exceeding the temperature Tsd.

In the aforementioned embodiment, the contents of the condition setting table D10 and the determination table D40 are not limited to the those illustrated, and may be changed. For example, the determination table D40 may indicate whether or not the recovery operation is performed for each of the fourteen types Dk when the detected type Dkd is detected for the other thirteen types Dk. As a result, it is possible to omit a process for determining a magnitude relationship between the change amounts of the process speed Vs and the electrification potential Vg.

In addition, configurations, operations, and processing contents, sequences, or items such as timings or operation condition values Dc, the number, specific values, threshold values such as thΔVs or thΔVm, or the like of the entire image forming apparatus 1 or each unit of the image forming apparatus 1 may be suitably changed depending on an object of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus that forms an image on a sheet under an operation condition set depending on a sheet type, comprising:

a processor that:

detects whether the sheet type is any one of a plurality of assumed types on the basis of an output of a sensor provided in a conveyance path of the sheet;

performs control such that an activation operation for forming the image under an interim condition, which is an operation condition corresponding to one of the plurality of assumed types, is performed before detecting the sheet type;

determines whether or not a recovery operation for optimizing a state of image formation is performed before starting image formation under a determinate condition, which is an operation condition corresponding to the detected type, on the basis of a magnitude of a difference between the determinate condition and the interim condition when the sheet type is detected;

performs control such that the recovery operation is performed when it is determined that the recovery operation is performed; and performs control such that the image formation is performed under the determinate condition after the recovery operation is performed, wherein the processor:

determines whether or not the magnitude of the difference between the determinate condition and the interim condition is zero;

upon determining that the magnitude of the difference is not zero, determines whether or not the magnitude of the difference is equal to or larger than a threshold value; and determines that the recovery operation is not performed before starting image formation under the determinate condition on the basis of the determination that the magnitude of the difference is smaller than the threshold value.

2. The image forming apparatus according to claim 1, wherein the processor determines to perform the recovery operation when a difference between an image formation speed of the determinate condition and an image formation speed of the interim condition is equal to or larger than the threshold value.

3. The image forming apparatus according to claim 1, wherein the image forming apparatus is a photoelectrographic image forming apparatus that forms the image using a photoreceptor, an electrification member that electrifies the photoreceptor, and a transfer member that transfers a toner image from the photoreceptor onto a transfer target body, and the processor determines to perform the recovery operation when a difference between an electrification potential of the photoreceptor included in the determinate condition and an electrification potential of the photoreceptor included in the interim condition is equal to or larger than the threshold value.

4. The image forming apparatus according to claim 3, further comprising an eraser that de-electrifies the photoreceptor onto which the toner image has been transferred, wherein the processor performs control such that an idling operation for rotating the photoreceptor to de-electrify a region electrified by the activation operation in the photoreceptor while maintaining the transfer member at a non-transfer potential is performed as the recovery operation.

5. The image forming apparatus according to claim 3, wherein the processor performs control such that an operation for rotating the transfer target body for a predetermined period of time is performed as the recovery operation.

6. The image forming apparatus according to claim 4, wherein the processor performs control such that the idling operation or a deactivation operation for returning the photoreceptor to a state immediately before starting the activation operation is performed as the recovery operation.

7. The image forming apparatus according to claim 3, further comprising a fixer that heats the sheet onto which the toner image is transferred, wherein the processor performs an operation for setting a target temperature of temperature adjustment to a temperature different from a fixation temperature included in the determinate condition as the recovery operation such that a temperature of the fixer smoothly approaches the fixation temperature.

8. The image forming apparatus according to claim 1, wherein the interim condition is an operation condition having the slowest image formation speed out of the operation conditions each corresponding to the plurality of assumed types.

* * * * *